US010624435B2

(12) United States Patent
Yu

(10) Patent No.: US 10,624,435 B2
(45) Date of Patent: Apr. 21, 2020

(54) CURLING IRON

(71) Applicant: Chin-Chun Yu, New Taipei (TW)

(72) Inventor: Chin-Chun Yu, New Taipei (TW)

(73) Assignees: Chin-Chun Yu, New Taipei (TW); Yung-Lin Lu, New Taipei (TW); Te-Jung Chang, New Taipei (TW)

( * ) Notice: Subject to any disclaimer, the term of this patent is extended or adjusted under 35 U.S.C. 154(b) by 376 days.

(21) Appl. No.: 15/613,299

(22) Filed: Jun. 5, 2017

(65) Prior Publication Data

US 2018/0343996 A1 Dec. 6, 2018

(51) Int. Cl.

*A45D 2/14* (2006.01)
*A45D 2/36* (2006.01)
*A45D 2/12* (2006.01)

(52) U.S. Cl.

CPC ..... *A45D 2/367* (2013.01); *A45D 2/122* (2013.01); *A45D 2/145* (2013.01); *A45D 2/146* (2013.01)

(58) Field of Classification Search

CPC ... A45D 1/02; A45D 1/04; A45D 1/28; A45D 1/16; A45D 2001/045; A45D 2/367; A45D 2/122; A45D 2/145; A45D 2/146; A45D 2/362

See application file for complete search history.

(56) References Cited

U.S. PATENT DOCUMENTS 1,386,371 A * 8/1921 Shepard ..... A45D 2/145 132/261
1,403,512 A * 1/1922 Mariner ..... A45D 2/145 132/226
1,424,546 A * 8/1922 Yeager ..... A45D 1/04 132/229
1,495,332 A * 5/1924 Koegel ..... A45D 1/04 132/269
1,646,173 A * 10/1927 Steichen ..... A45D 2/145 132/261
2,394,973 A * 2/1946 Bergen ..... A45D 2/367 132/242
3,488,471 A * 1/1970 Gstalder ..... A45D 2/367 219/222
3,507,291 A * 4/1970 Gaxiola ..... A45D 2/145 132/210
3,566,887 A * 3/1971 Nelson ..... A45D 2/146 132/262
4,492,241 A * 1/1985 Thaler ..... A45D 1/18 132/229
4,513,761 A * 4/1985 Van Deursen ..... A45D 2/122 132/251

(Continued)

*Primary Examiner* — Nicholas D Lucchesi

(57) ABSTRACT

A curling iron contains: a body, a fitting sleeve, a plug, and multiple clampers. The body includes multiple rolling ribs arranged in a stepped shape and includes two stop portions. Two opposing rolling ribs on two peripheral sides of the body respectively do not flush with each other and are separated. The body also includes an orifice and a hollow portion, wherein the hollow portion has two retaining slots. The fitting sleeve includes two locking portions corresponding to the two retaining slots of the body. A diameter of the plug is equal to that of the orifice of the body, each of the multiple clampers includes a fixing portion and a clamping portion, and the fitting sleeve is fitted into the hollow portion of the body. The plug is accommodated in the orifice of the body, and each clamper clamps the body.

7 Claims, 6 Drawing Sheets

(56) References Cited

U.S. PATENT DOCUMENTS

| | | | | | |
|---|---|---|---|---|---|
| 4,641,010 | A * | 2/1987 | Abura | A45D 1/04 | 132/212 |
| 4,743,735 | A * | 5/1988 | Abura | A45D 1/04 | 132/212 |
| 4,756,320 | A * | 7/1988 | Andis | A45D 1/04 | 132/229 |
| 5,808,275 | A * | 9/1998 | Hibri | A45D 2/367 | 132/229 |
| 8,646,465 | B2 * | 2/2014 | Tam | A45D 2/12 | 132/211 |
| 2009/0056735 | A1 * | 3/2009 | Suh | A45D 2/367 | 132/217 |
| 2011/0259357 | A1 * | 10/2011 | Levine | A45D 1/04 | 132/229 |
| 2014/0020705 | A1 * | 1/2014 | Parker | A45D 2/122 | 132/270 |
| 2014/0311519 | A1 * | 10/2014 | Cho | A45D 2/122 | 132/251 |

* cited by examiner

CURLING IRON

FIELD OF THE INVENTION

The present invention relates to a curling iron which perms user's hairs evenly, quickly, and easily.

BACKGROUND OF THE INVENTION

As illustrated in FIG. 1, a conventional curling iron 1 is applied to roll tips and roots of user's hairs 2, and multiple rubber bands 10 tie the user's hair so that the curling iron 1 heats the user's hairs. However, the user's hairs cannot be heated evenly. For example, the tips are heated more, but the roots are heated less. The multiple rubber bands 10 are broken after being heated.

Furthermore, the tips of the user's hairs are heated at a higher temperature than a heated temperature of the roots, so the user's hairs are damaged easily and cannot be premed evenly.

Also, the conventional curling iron 1 is heated by electricity, so it cannot be washed after perming the user's hairs.

The present invention has arisen to mitigate and/or obviate the afore-described disadvantages.

SUMMARY OF THE INVENTION

The primary objective of the present invention is to provide a curling iron which perms user's hairs evenly, quickly, and easily.

To obtain above-mentioned objective, a curling iron provided by the present invention contains: a body, a fitting sleeve, a plug, and multiple clampers.

The body is formed in a bar shape and includes multiple rolling ribs arranged on two peripheral sides of the body respectively, the body also includes two stop portions individually fixed on a first end and a second end of the body respectively. The multiple rolling ribs are arranged in a stepped shape and crisscross with one another. In addition, the body includes an orifice defined on the first end of the body, and the body includes a hollow portion extending from the first end of the body to the second end of the body, wherein the hollow portion has two retaining slots respectively arranged on two sides of the hollow portion and configured to accommodate a heating plate.

The fitting sleeve includes two locking portions respectively arranged on two sides of the fitting sleeve so as to correspond to the two retaining slots of the body.

A diameter of the plug is equal to that of the orifice of the body.

Each of the multiple clampers includes a fixing portion and a clamping portion.

The fitting sleeve is fitted into the hollow portion of the body, the plug is accommodated in the orifice of the body, and each clamper clamps the body.

Preferably, the body has a slope so as to form a wide segment on the first end of the body and to form a narrow segment on the second end of the body.

Preferably, the body is made of plastic material.

Preferably, each of the multiple rolling ribs is arcuate.

Preferably, the hollow portion is vacuumed and accommodates the fitting sleeve and the plug.

Preferably, the fitting sleeve has a plurality of electric pins, a first end of each of the plurality of electric pins is connected with the heating plate of the body, and a second end of each electric pin is electrically connected with power supply equipment.

Preferably, a number of the multiple clampers is two, one of the two clampers clamps on the wide segment, and the other of the two clampers clamps on the narrow segment.

DETAILED DESCRIPTION OF THE PREFERRED EMBODIMENTS

Figure 1:
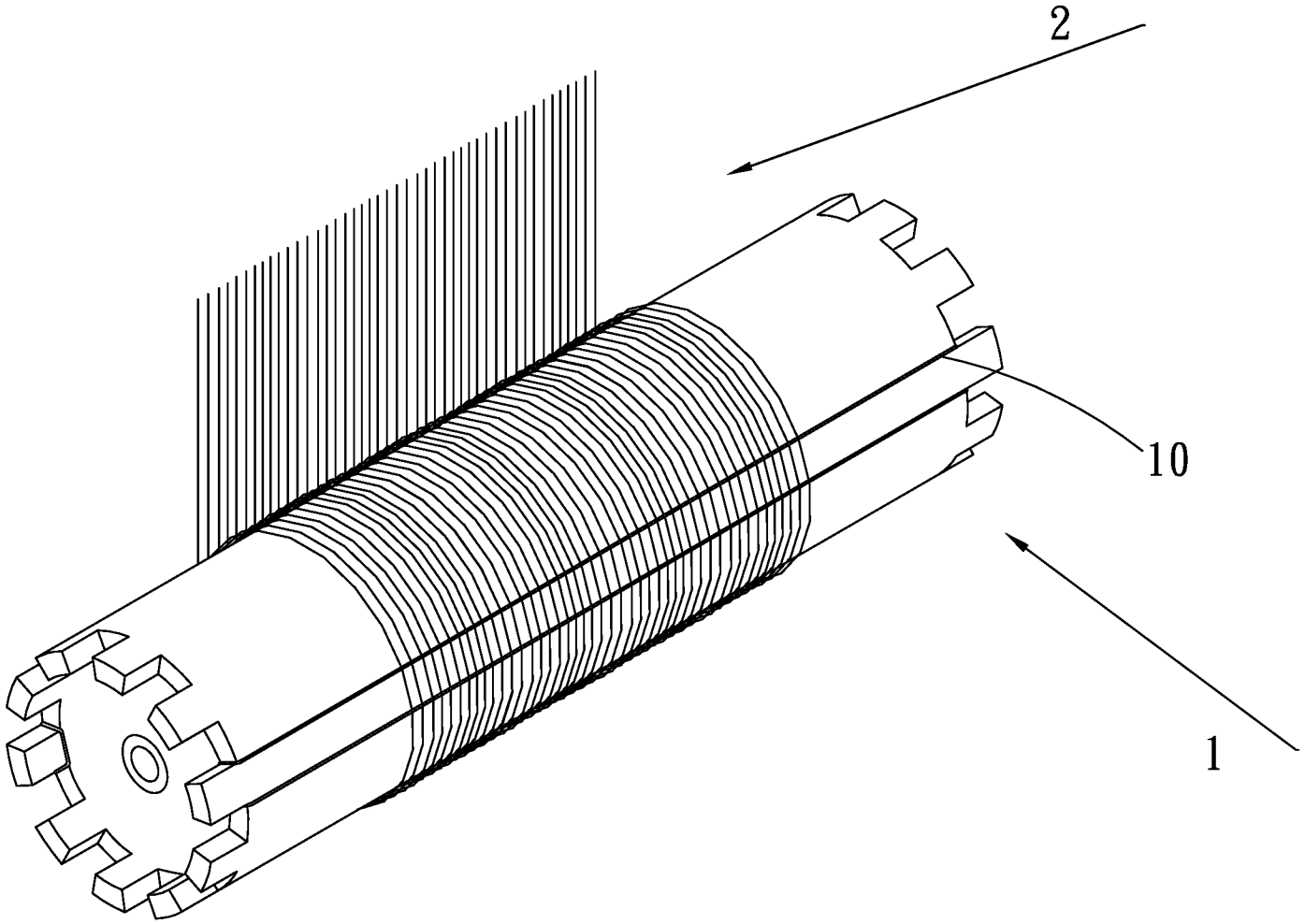
FIG. 1 PRIOR ART
FIG. 1 is a perspective view of a conventional curling iron.
Figure 2:
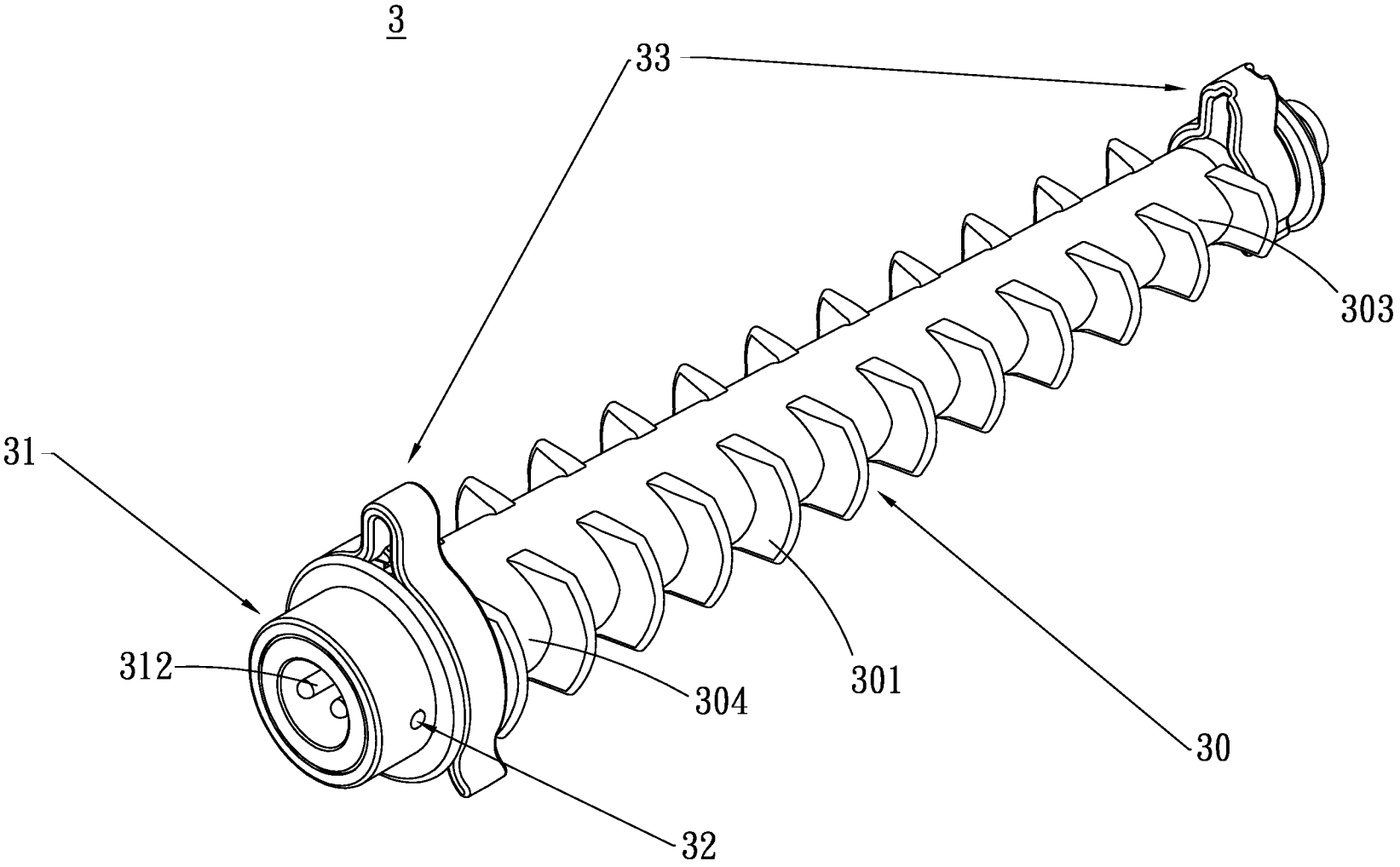
FIG. 2 is a perspective view showing the assembly of a curling iron according to a first embodiment of the present invention.
Figure 3:
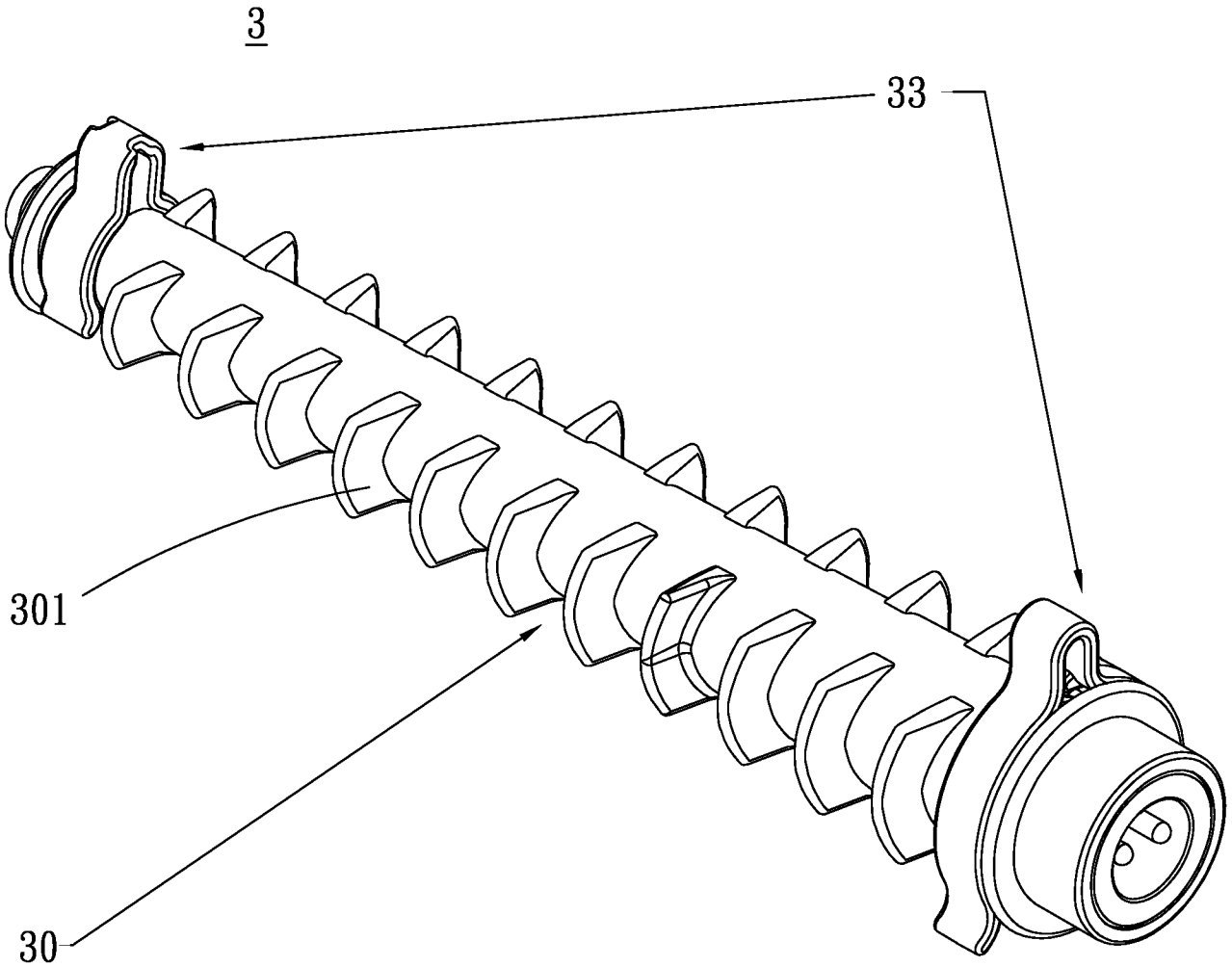
FIG. 3 is another perspective view showing the assembly of the curling iron according to the first embodiment of the present invention.
Figure 4:
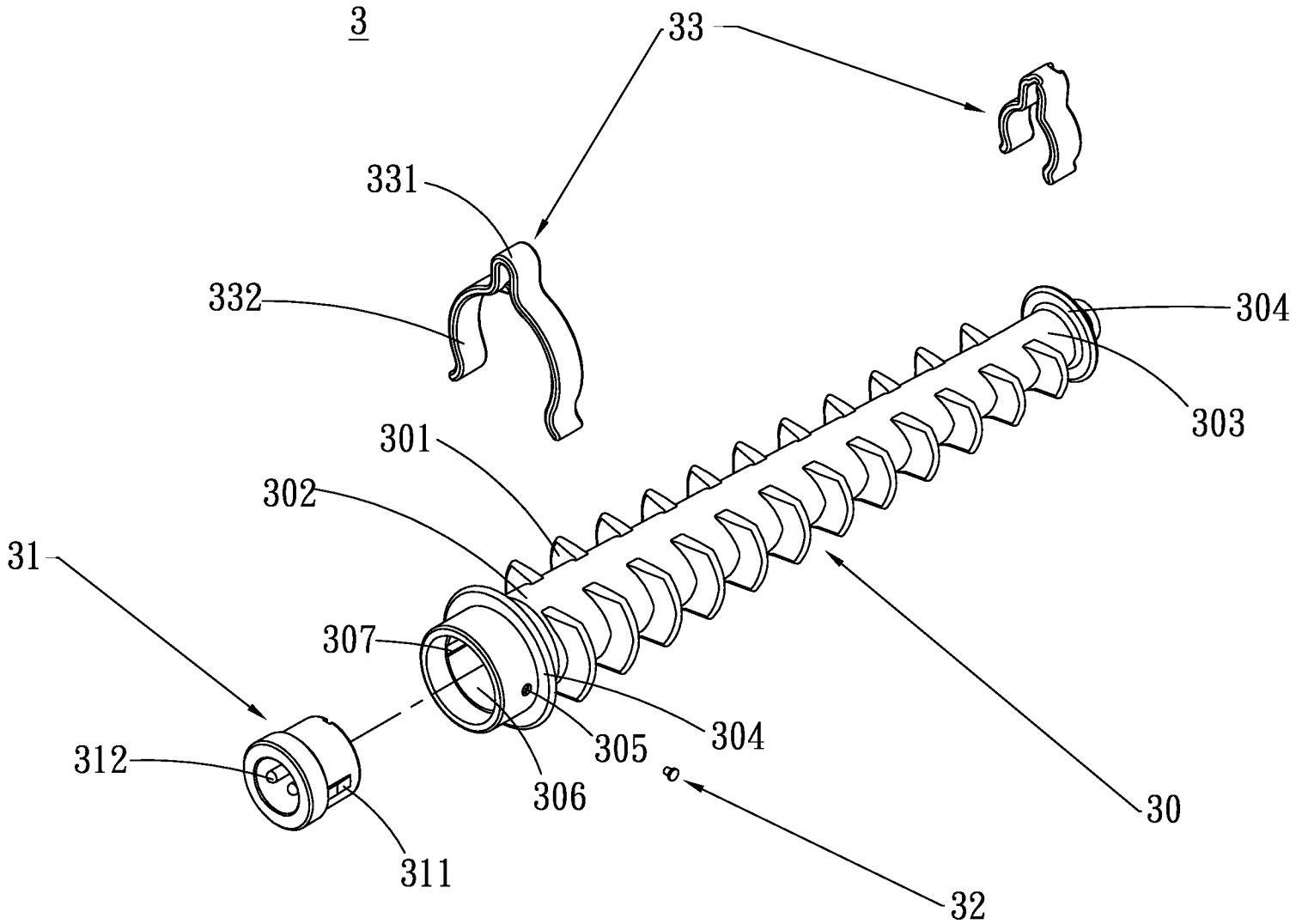
FIG. 4 is a perspective view showing the exploded components of the curling iron according to the first embodiment of the present invention.
Figure 5:
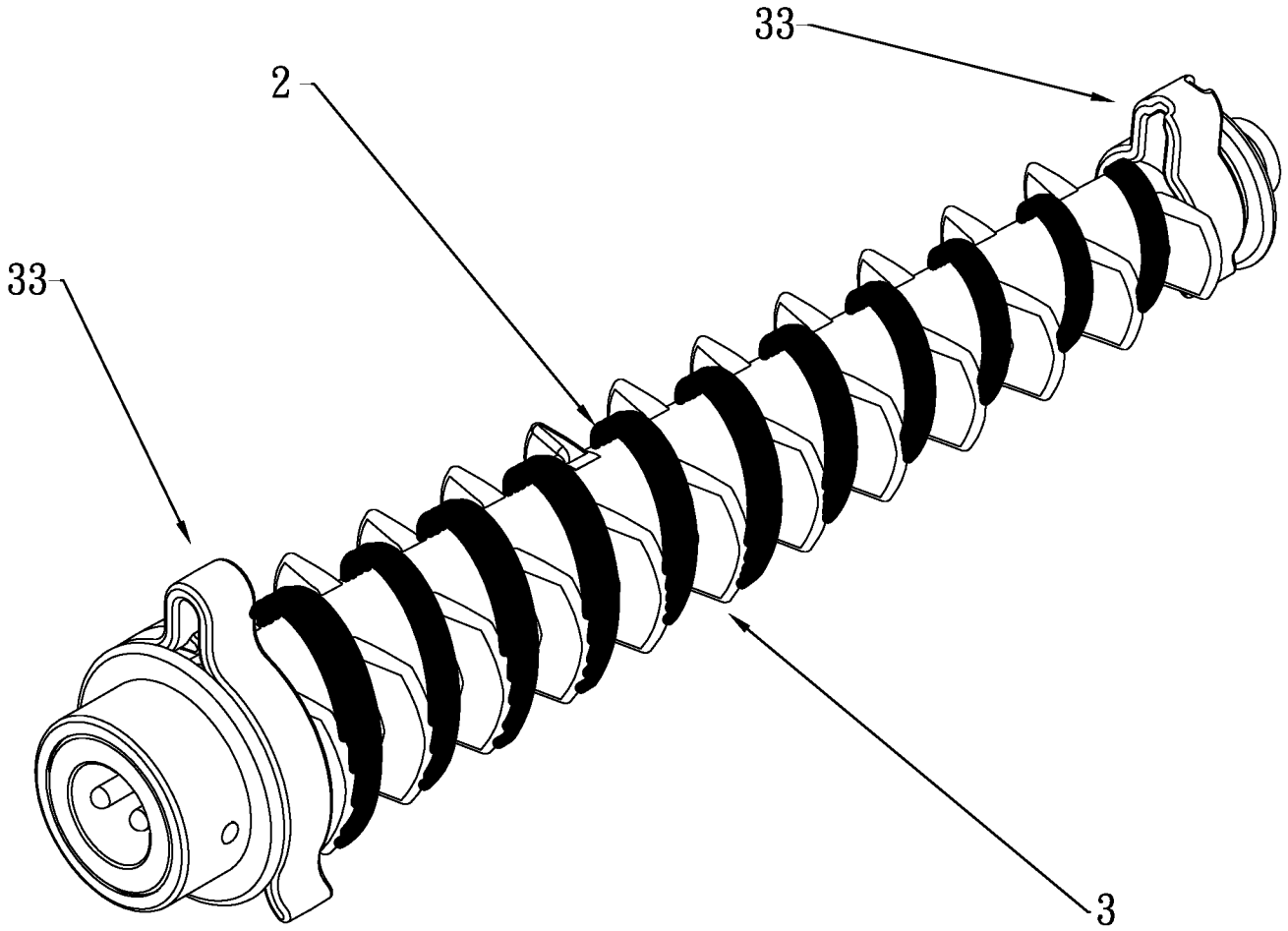
FIG. 5 is a perspective view showing the operation of the curling iron according to the first embodiment of the present invention.

With reference to FIGS. 2 to 5, a curling iron 3 according to a first embodiment of the present invention comprises: a body 30, a fitting sleeve 31, a plug 32, and multiple clampers 33.

The body 30 is formed in a bar shape and includes multiple rolling ribs 301 arranged on two peripheral sides of the body 30 respectively, wherein the multiple rolling ribs 301 are arranged in a stepped shape and crisscross with one another, and the body 30 has a slope so as to form a wide segment 302 on a first end of the body 30 and to form a narrow segment 303 on a second end of the body 30. The body 30 also includes two stop portions 304 individually fixed on the first end and the second end of the body 30, an orifice 305 defined on one side of the wide segment 302, a hollow portion 306 extending from the first end of the body 30 to a second end of the body 30, wherein the hollow portion 306 has two retaining slots 307 respectively arranged on two sides thereof and configured to accommodate a heating plate.

The fitting sleeve 31 includes two locking portions 311 respectively arranged on two sides thereof so as to correspond to the two retaining slots 307 of the body 30.

A diameter of the plug 32 is equal to that of the orifice 305 of the body 30 so that the plug 32 matingly inserts into the orifice 305 of the body 30.

Each of the multiple clampers 33 includes a fixing portion 331 and a clamping portion 332. The fitting sleeve 31 is fitted into the hollow portion 306 of the body 30, the plug 32 is accommodated in the orifice 305 of the body 30, and each clamper 33 clamps the body 30.

The body 30 is made of plastic material, each of the multiple rolling ribs 301 is arcuate, and the hollow portion 306 is vacuumed and accommodates the fitting sleeve 31 and the plug 32. The fitting sleeve 31 has a plurality of electric pins 312, a first end of each of the plurality of electric pins 312 is connected with the heating plate of the body 30, and a second end of each electric pin 312 is electrically connected with power supply equipment (not shown) so that the curling iron is heated to perm user's hairs.

In operation, the user's hairs 2 is rolled on the multiple rolling ribs 301 of the body 30 based on steps of: rolling roots of the user's hairs 2 to the narrow segment 303 of the body 30, crisscross and spirally rolling the user's hairs 2 to the wide segment 302, and clamping the user's hairs 2 by using the multiple clampers 33 so as to fix the user's hairs on the body 30, wherein a number of the multiple clampers 33 is two, one of the two clampers 33 clamps on the wide segment 302, and the other clamper 33 clamps on the narrow segment 303.

Thereby, the roots of the user's hairs 2 are adjustably rolled by the narrow segment 303, and tips of the user's hairs are rolled slightly to avoid damage. The user's hairs 2 do not stack together, and they evenly roll on the body 30 so as to be premed quickly.

Figure 6:
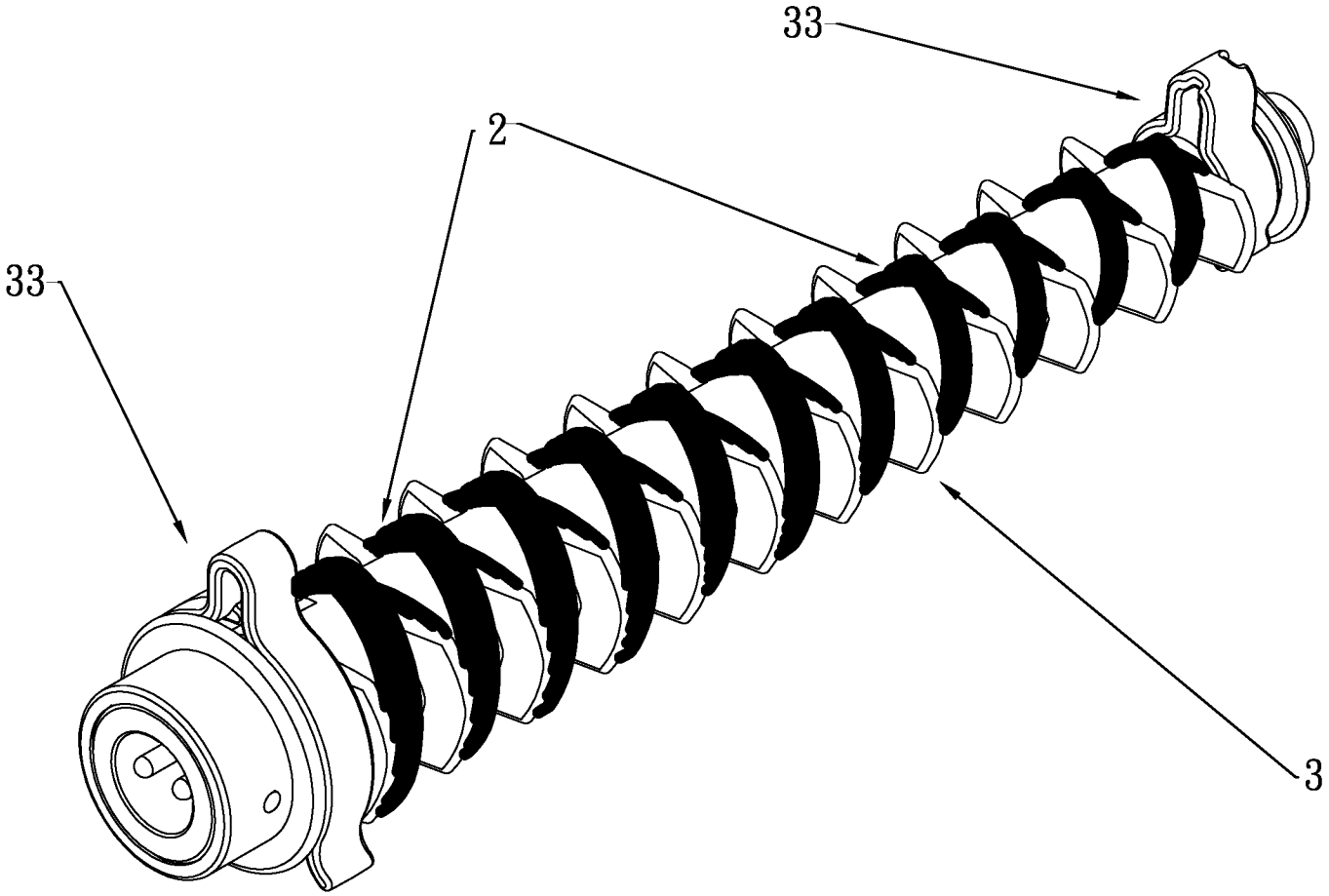
FIG. 6 is a perspective view showing the operation of the curling iron according to a second embodiment of the present invention.

Referring to FIG. 6, in a second embodiment, two hair bundles 2 are crisscross rolled on the body 30 simultaneously based on steps of: rolling one of two hair bundles 2 in a clockwise direction; and rolling the other of the two hair bundles 2 in a counterclockwise direction, such that the curling iron 3 perms the two hair bundles 2 quickly, and a using number of the curling iron 3 is reduced.

While the preferred embodiments of the invention have been set forth for the purpose of disclosure, modifications of the disclosed embodiments of the invention as well as other embodiments thereof may occur to those skilled in the art. The scope of the claims should not be limited by the preferred embodiments set forth in the examples, but should be given the broadest interpretation consistent with the description as a whole.

What is claimed is:

1. A curling iron comprising:

a body formed in a bar shape and including multiple rolling ribs arranged on two peripheral sides of the body respectively, two stop portions individually fixed on a first end and a second end of the body respectively, wherein the multiple rolling ribs are arranged in a stepped shape and, two opposing rolling ribs of the multiple rolling ribs on the two peripheral sides of the body respectively do not flush with each other and are separated from each other, the body also includes an orifice defined on the first end of the body, and the body includes a hollow portion extending from the first end of the body to the second end of the body, wherein the hollow portion has two retaining slots respectively arranged on two sides of the hollow portion, and a heating plate is accommodated in the two retaining slots;

a fitting sleeve including two locking portions respectively arranged on two sides of the fitting sleeve so as to correspond to the two retaining slots of the body;

a plug, a diameter of which is equal to that of the orifice of the body;

multiple clampers, each of the multiple clampers including a fixing portion and a clamping portion;

wherein the fitting sleeve is fitted into the hollow portion of the body, the plug is accommodated in the orifice of the body, and each clamper clamps the body.

2. The curling iron as claimed in claim 1, wherein the body has a slope so as to form a wide segment on the first end of the body and to form a narrow segment on the second end of the body.

3. The curling iron as claimed in claim 1, wherein the body is made of plastic material.

4. The curling iron as claimed in claim 1, wherein each of the multiple rolling ribs is arcuate.

5. The curling iron as claimed in claim 1, wherein the hollow portion is vacuumed and accommodates the fitting sleeve and the plug.

6. The curling iron as claimed in claim 1, wherein the fitting sleeve has a plurality of electric pins, a first end of each of the plurality of electric pins is connected with the heating plate of the body, and a second end of each electric pin is electrically connected with power supply equipment.

7. The curling iron as claimed in claim 1, wherein a number of the multiple clampers is two, one of the two clampers clamps on the wide segment, and the other of the two clampers clamps on the narrow segment.

* * * * *